US010173882B2

(12) United States Patent
Savese

(10) Patent No.: US 10,173,882 B2
(45) Date of Patent: Jan. 8, 2019

(54) APPARATUS FOR DRAWING BEVERAGES

(71) Applicants: SAVESE F.LLI INDUSTRIES S.R.L., Giaveno (Turin) (IT); Marcello Savese, Giaveno (Turin) (IT)

(72) Inventor: Marcello Savese, Giaveno (IT)

(73) Assignee: SAVESE F.LLI INDUSTRIES S.R.L., Giaveno (Turin) (IT)

( * ) Notice: Subject to any disclaimer, the term of this patent is extended or adjusted under 35 U.S.C. 154(b) by 0 days.

(21) Appl. No.: 15/577,873

(22) PCT Filed: May 26, 2016

(86) PCT No.: PCT/IB2016/053091
§ 371 (c)(1),
(2) Date: Nov. 29, 2017

(87) PCT Pub. No.: WO2016/193871
PCT Pub. Date: Dec. 8, 2016

(65) Prior Publication Data

US 2018/0162712 A1 Jun. 14, 2018

(30) Foreign Application Priority Data

May 29, 2015 (IT) ..... 10201519345

(51) Int. Cl.
*B67D 1/08* (2006.01)
*B67D 3/00* (2006.01)
*B67D 1/06* (2006.01)

(52) U.S. Cl.
CPC ..... *B67D 1/0884* (2013.01); *B67D 1/06* (2013.01); *B67D 1/0879* (2013.01); (Continued)

(58) Field of Classification Search
CPC .. B67D 1/0884; B67D 1/0864; B67D 1/0885; B67D 1/0882; B67D 3/0009; B67D 1/06; (Continued)

(56) References Cited

U.S. PATENT DOCUMENTS

2004/0226313 A1* 11/2004 Busick ..... B67D 3/0009 62/397
2009/0320508 A1 12/2009 Linder
(Continued)

FOREIGN PATENT DOCUMENTS

EP 1642863 A1 5/2006
EP 2325134 A1 * 5/2011
(Continued)

OTHER PUBLICATIONS

Patent Cooperation Treaty, Notification of Transmittal of the International Search Report and the Written Opinion of the International Searching Authority, or the Declaration for PCT/IB2016/053091 dated Sep. 20, 2016, 11 pages.

*Primary Examiner* — Emmanuel Duke
(74) *Attorney, Agent, or Firm* — Heslin Rothenberg Farley & Mesiti P.C.; Victor A. Cardona, Esq.

(57) ABSTRACT

An Apparatus for drawing beverages, such as beer, includes a casing in which there is housed a compression refrigeration unit and has a receptacle located superiorly and adapted to contain the barrel of the beverage. The receptacle is refrigerated by the refrigeration unit. The casing is provided with a compartment, located frontally and also refrigerated by a refrigeration unit, configured to contain drinking glasses accessible through an openable front door of the casing.

5 Claims, 2 Drawing Sheets

(52) U.S. Cl.
CPC ..... *B67D 1/0882* (2013.01); *B67D 1/0885* (2013.01); *B67D 3/0009* (2013.01); *B67D 3/0029* (2013.01); *B67D 3/0054* (2013.01)

(58) Field of Classification Search
CPC .. B67D 3/0054; B67D 3/0029; B67D 1/0879; F25D 31/002; F25D 31/007; F25D 31/00; F25D 31/006
See application file for complete search history.

(56) References Cited

U.S. PATENT DOCUMENTS

| | | | | |
|---|---|---|---|---|
| 2014/0260412 | A1* | 9/2014 | Keast | F25D 11/003 62/457.9 |
| 2015/0233631 | A1* | 8/2015 | Shuntich | F25D 31/007 62/64 |

FOREIGN PATENT DOCUMENTS

| | | | |
|---|---|---|---|
| EP | 2325134 | A1 | 5/2011 |
| FR | 2564815 | A1 | 11/1985 |

* cited by examiner

APPARATUS FOR DRAWING BEVERAGES

CROSS REFERENCE TO RELATED APPLICATIONS

This application is a national stage filing under section 371 of International Application No. PCT/IB2016/053091, filed on May 26, 2016, published in English on Dec. 8, 2016, as WO2016/193871 A1 and which claims priority to Italian Application No. 102015000019345, filed on May 29, 2015, the entire disclosure of these applications being hereby incorporated herein by reference.

FIELD OF THE INVENTION

The present invention generally refers to the dispensing of beverages contained in pressurised barrels, particularly beer.

STATE OF THE ART

Typically the dispensing of beverages thus made occurs by means of refrigerated drawing apparatus adapted to operate with barrels having capacity in the order of 30 liters and above: besides being relatively complex, such apparatus have considerable overall dimensions and they are not suitable for any other use apart from professional purposes.

Barrels or kegs, for example in the order of 5 liters, that can be used practically both for commercial or domestic purposes have recently become common in the market. However, these barrels reveal the drawback related to maintaining the temperature of the beverage at values sufficiently low for consumption, usually not above 4° C., and also facilitating the dispensing thereof.

SUMMARY OF THE INVENTION

The object of the present invention is to provide an apparatus for drawing beverages in low capacity barrels, hence allowing overcoming the aforementioned drawback in an efficient, practical and functional manner.

According to the invention, this object is attained thanks to the fact that the apparatus comprises a container in which there is housed a compression refrigeration unit and having a receptacle arranged at the upper part and adapted to contain the beverage barrel. The receptacle is refrigerated by the refrigeration unit and the container also has a compartment located frontally in a position underlying said receptacle, the compartment also being refrigerated by said refrigeration unit and configured to contain drinking glasses accessible through an openable front door of the casing.

The receptacle for the barrel is conveniently constituted by a hollow cylindrical body made of a high heat conductivity metal, for example made of aluminium, cooled through a first coil evaporator of the refrigeration unit. The compartment for the drinking glasses is in turn refrigerated by a second evaporator of the refrigeration unit.

BRIEF DESCRIPTION OF THE DRAWINGS

The invention will now be described in detail, purely by way of non-limiting example, with reference to the attached drawings, wherein.

DETAILED DESCRIPTION OF THE INVENTION

Figure 1:
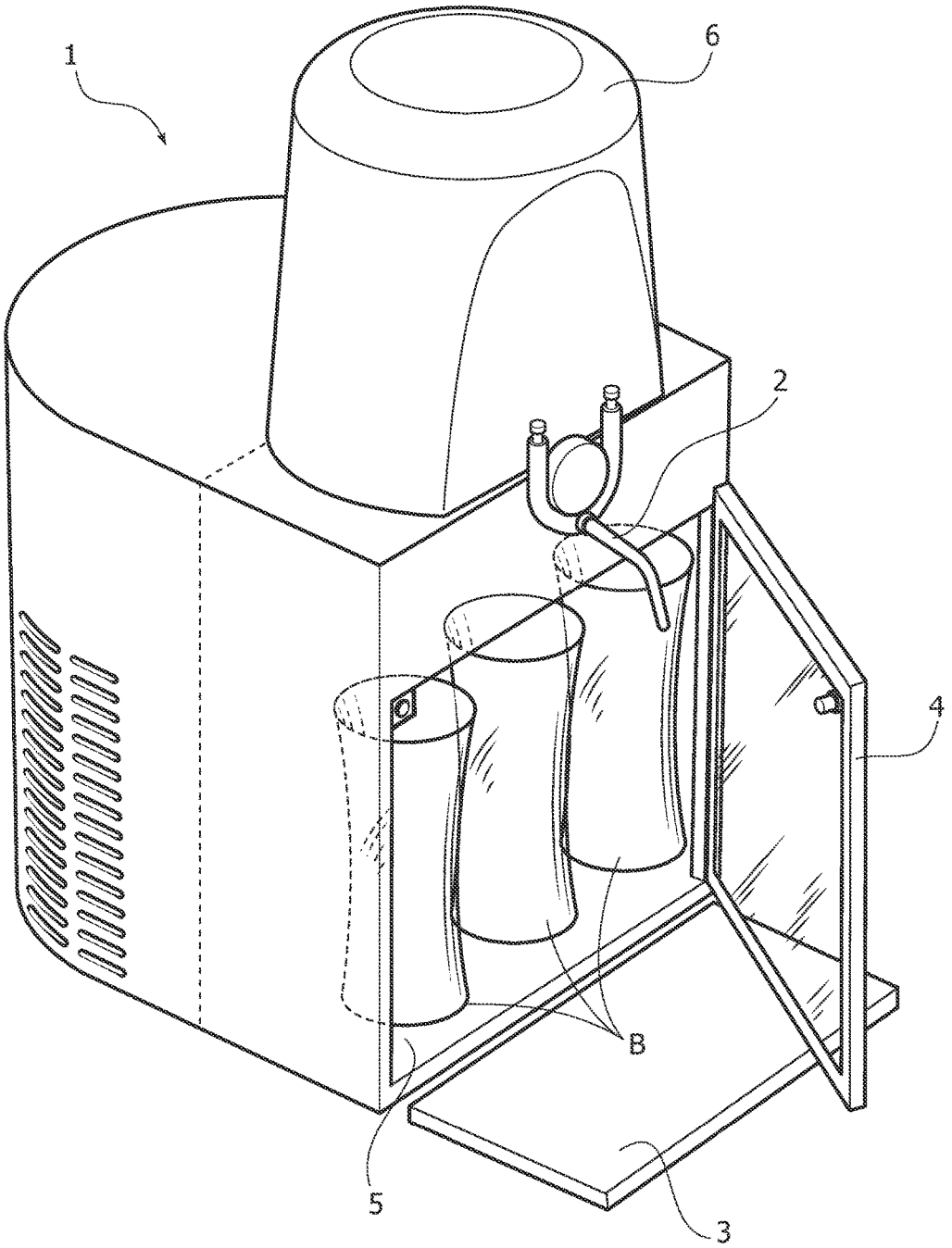
FIG. 1 is a schematic front perspective view of a drawing apparatus according to the invention.
Figure 2:
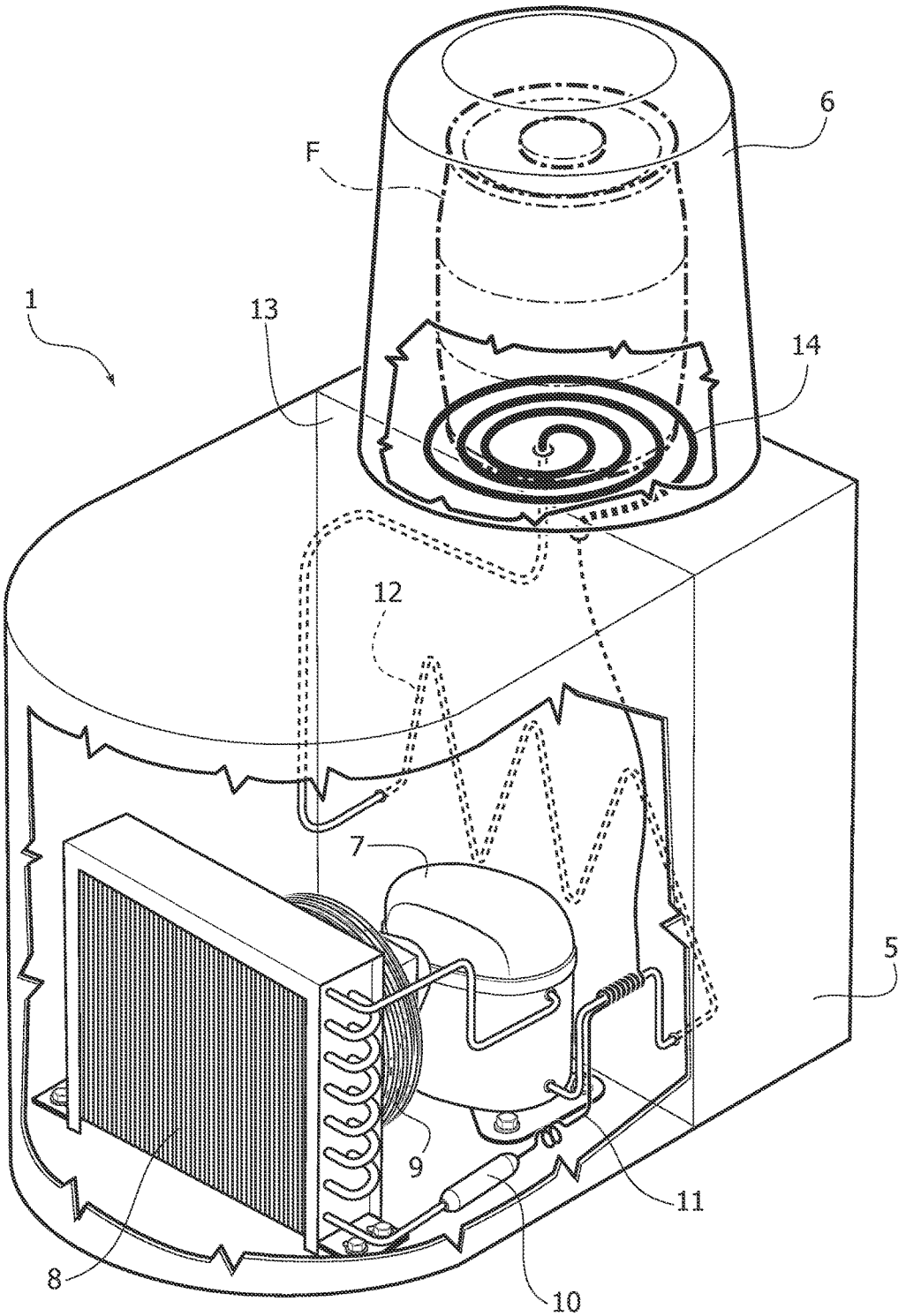
FIG. 2 is a dorsal and partly broken perspective view of the drawing apparatus.

With reference to the drawings, the drawing apparatus according to the invention comprises a casing indicated in its entirety with 1, having dimensions such to be positionable on the counter of a business premises or even easily used in a domestic environment. The front part of the casing 1 has a dispensing spout 2 projecting above a grid 3 for positioning the glass meant for receiving the beverage, typically beer. Beneath the spout 2, the front part of the casing 1 has an openable door 4, for example transparent, for access to a refrigerated compartment 5 adapted to contain one or more drinking glasses B.

From the top part of the container 1 there projects a hollow cylindrical body 6 made of a high heat conductivity metal, for example aluminium, within which there can be positioned a barrel or keg F, typically in the order of 5 liters, containing the beer to be drawn. At the lower part, the barrel F is provided—in a known fashion—with a dispensing mouth connectable with the dispensing spout 2.

The rear part of the casing 1, i.e. the part located behind the compartment 5, houses a compression refrigeration unit comprising—associated in a conventional fashion—a compressor 7, a condenser 8 with a fan 9, an expansion filter 10, a lamination capillary 11 and, according to the invention, a double evaporator. A first evaporator, indicated with 12, is preferably configured in a zigzag fashion and it is applied to the rear metal part 13 of the compartment 5. A second evaporator, indicated with 14, is preferably configured in a spiral fashion and it is arranged at the base of the cylindrical body 6 that defines the receptacle for the barrel F. Thus, this second evaporator 14 cools the cylindrical body 6 and the barrel F through heat conduction by the latter.

The coolant in circulation in the refrigeration unit of the apparatus is conveniently an ecological gas r290, which advantageously allows reducing the release of $CO_2$ into the environment thus also guaranteeing the reduction of energy consumption to the advantage of eco-sustainability.

In operation, the coolant—initially in gaseous state—is compressed by the compressor 7 with the ensuing increase of the temperature thereof. The temperature is then lowered through the condenser 8 and the fan 9, bringing the coolant from gaseous to the liquid state. The temperature of the coolant, which goes from liquid state to a two-phase mixture, i.e. gas-liquid mixture, is further lowered by the laminar-flow capillary 11. Thus, the gas-liquid coolant is injected into the evaporator 14, incorporated—as mentioned—in the base of the cylindrical body 6, which is thus cooled in turn causing the cooling of the barrel F inserted therein by conduction.

Thus, the coolant reaches the evaporator 12, before returning to the gaseous state completely, thus also cooling the compartment 5 containing the glasses B. Lastly, the coolant, in gaseous state, is returned to the compressor 7 to repeat the refrigeration cycle.

This cycle, controlled by a programmable electronic control unit, can be repeated and controlled through a thermostat by means of which the temperature of the receptacle 6, and thus that of the compartment 5, is maintained at preset values, typically in the order of 3-4° C.

An anti-bacterial UV LED for sterilising the drinking glasses B may be provided for in the compartment 5.

In the light of the above, besides having small dimensions and being suitable to allow both the advantageous use on the counters of business premises as well as domestic use, it is clear that drawing apparatus according to the invention allows maintaining the temperature of the beverage contained in the barrel F at the ideal drawing values, and such temperature may then be maintained subsequently longer due to the cooling of the glasses in which it is dispensed.

Obviously, the construction details and the embodiments may widely vary with respect to what has been described and illustrated, without departing from the scope of protection of the present invention as described in the claims that follow.

The invention claimed is:

1. An Apparatus for drawing beverages, contained in barrels having a limited capacity, comprising:

a casing housing a compression refrigeration unit and having a receptacle arranged superiorly and designed to contain therein a beverage barrel, said receptacle being refrigerated by the refrigeration unit, the casing comprising a compartment located frontally in a position underlying said receptacle, and said compartment being refrigerated by said refrigeration unit and being configured to contain drinking glasses accessible through an openable front door of the casing.

2. Apparatus according to claim 1, wherein said receptacle is defined by a hollow cylindrical metal body cooled by a coil evaporator of the refrigeration unit.

3. Apparatus according to claim 2, wherein said compartment is cooled by a zigzag evaporator of the refrigeration unit.

4. Apparatus according to claim 1, wherein said compartment is cooled by a zigzag evaporator of the refrigeration unit.

5. Apparatus according to claim 1, wherein the beverage barrel holds beer.

* * * * *